US006041835A

United States Patent [19]

Price

[11] Patent Number: 6,041,835

[45] Date of Patent: Mar. 28, 2000

[54] CONTAINER RIM SHIELD FOR CONTAINER FILLING APPARATUS

[75] Inventor: Richard T. Price, Lehi, Utah

[73] Assignee: Muiti-Fill, Inc., West Jordan, Utah

[21] Appl. No.: 09/100,413

[22] Filed: Jun. 20, 1998

[51] Int. Cl.[7] ..... B65B 1/04

[52] U.S. Cl. ..... 141/370; 141/311 A; 141/369; 141/390

[58] Field of Search ..... 141/370, 311 A, 141/369, 392, 339, 390, 373, 371, 372, 283; 53/250

[56] References Cited

U.S. PATENT DOCUMENTS

| | | | |
|---|---|---|---|
| 797,144 | 8/1905 | Nickerson | 141/34 |
| 2,026,602 | 1/1936 | Young | 141/59 |
| 2,353,519 | 7/1944 | Spurr | 141/140 |
| 3,509,920 | 5/1970 | Word | 141/100 |

*Primary Examiner*—Steven O. Douglas
*Assistant Examiner*—Peter deVore
*Attorney, Agent, or Firm*—Thorpe, North & Western, LLP

[57] ABSTRACT

Structure for shielding the upper surface of rim flanges of containers positioned for filling with material from a filling head of a container filling device includes a mounting base for attaching to the container filling device, and a shield formed with a pair of arms projecting from the mounting base in a generally parallel, spaced apart relationship to overlie or cover respective opposing side rim flanges of the container, while allowing material to be dispensed from the filling head between the arms to the container. A plate extends between the arms at one end thereof to cover the rim flange of the container that extends between the opposing side rim flanges, so that the combination of the two arms and plate serves to cover and shield the upper surface of the rim flanges from material being deposited into the container.

9 Claims, 4 Drawing Sheets

CONTAINER RIM SHIELD FOR CONTAINER FILLING APPARATUS

BACKGROUND OF THE INVENTION

This invention relates to container filling apparatus and more particularly to structure for shielding the rims of the containers being filled, from product or material being dispensed by the container filling apparatus into the containers.

Apparatus and processes for automatically filling containers such as cans, trays or the like with both food and non-food products have become very sophisticated in recent years. Such apparatus and processes are used to fill containers with liquid, semi-liquid, pasty or solid products including both food products, such as liver paste, baby foods, jellies, vegetable oil, mustard, sauces, etc., and non-food products, such as mineral oil, wax, paints, etc.

As might be expected, occasionally the material being dispensed into the containers splashes or otherwise is deflected from the inside of the container, and this can be both messy and unsanitary. An additional problem arises when material splashes onto the rims of the openings of the containers which are to be covered and sealed later. If material is present on the upper surface of a container rim and a cover is then placed over the opening in contact with the rim, the material may prevent obtaining a secure seal between the cover and the rim.

SUMMARY OF THE INVENTION

It is an object of the invention to provide container filling apparatus in which the rims of openings of containers being filled are shielded from contact by the material being dispensed into the containers.

It is also an object of the invention to provide structure for shielding the rims of containers which are automatically moved into position under a material dispensing nozzle or head of such a container filling apparatus.

It is a further object of the invention to provide such structure which may be easily manufactured and installed, and which does not interfere with the automatic filling operation of the container filling apparatus.

The above and other objects are realized in a specific illustrative embodiment of structure for shielding the rims of openings of containers positioned for filling from a filling head or nozzle of container filling apparatus, where the filling head is disposed above the container. The structure includes a base mountable on the container filling apparatus generally below the level of the filling head, and projections extending from the base generally horizontally, and configured to overlie at least a portion of the rim of the container when the container is in position under the filling head. The projections, advantageously, are spaced apart and configured to cover or overlie the rims of the containers to shield the rims from material being dispensed between the projections into the containers.

In accordance with one aspect of the invention, shielding structure is provided for generally rectangularly shaped containers having rim flanges on which a cover will ultimately be placed. The shielding structure includes a pair of generally parallel, spaced-apart arms projecting from the base to generally overlie respective opposing side rim flanges of the container, and a plate extending between the arms at one end thereof to overlie another side rim flange of the container (which extends between the opposing side rim flanges).

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
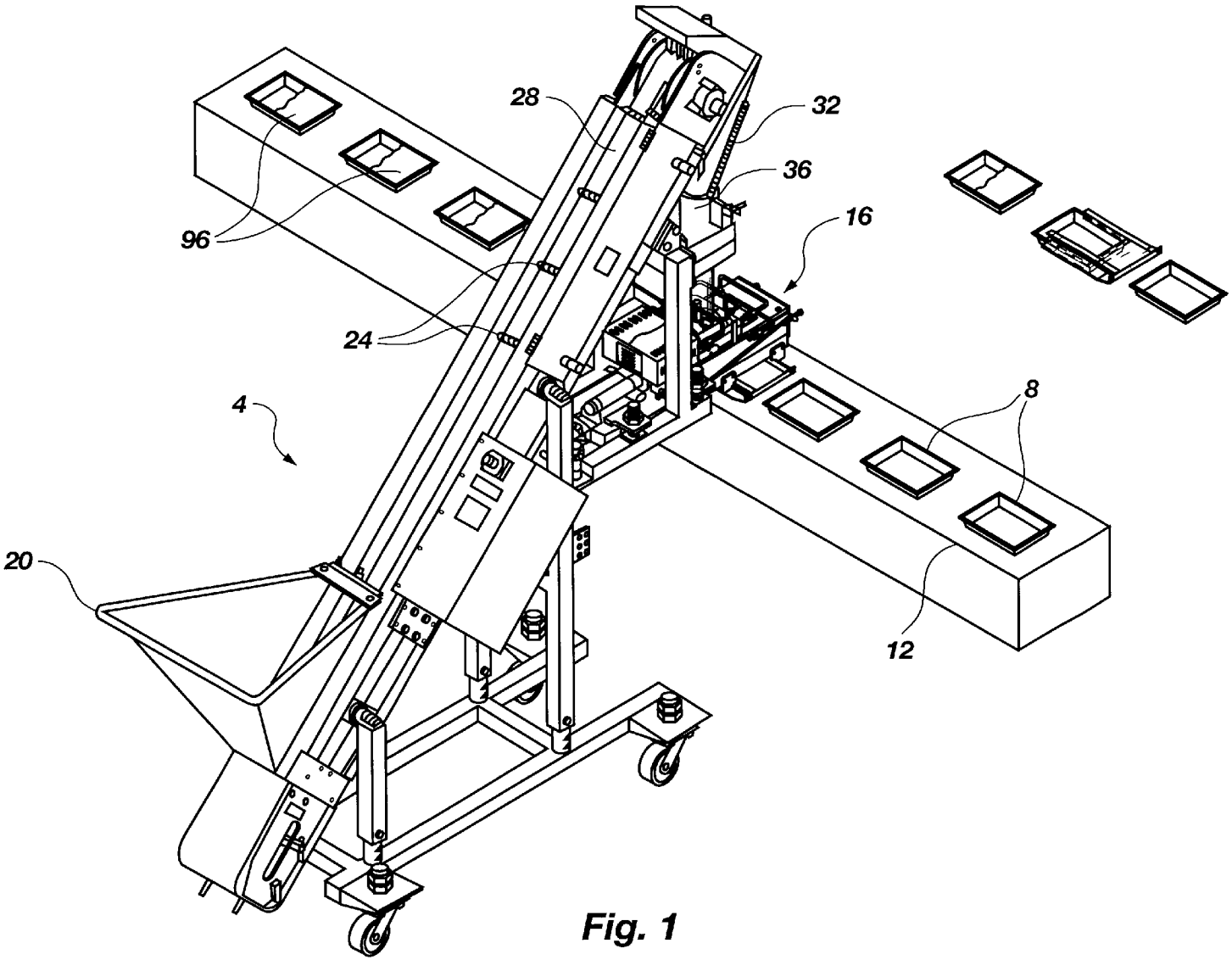
FIG. 1 is a perspective view of container filling apparatus with container rim shielding structure made in accordance with the principles of the present invention.

Referring to FIG. 1, there is shown a perspective view of a container filling apparatus 4 by which food product is dispensed or deposited in trays 8 being moved by conveyor 12 (illustrated graphically) successively under a filling head 16 of the container filling apparatus. The container filling apparatus 4 is illustrative of one type of container filling machine presently available commercially, the apparatus being the MPF system, manufactured by Multi-Fill, Inc. of West Jordan, Utah. In this apparatus, food product is deposited in a hopper 20 where it is carried by flights 24 of an endless belt 28 upwardly for deposit in another hopper or bin 32. From there the food product moves downwardly through a hollow cylinder 36 to the filling head 16 which automatically discharges a measured amount of food product into each tray 8 as each tray is moved into position underneath the filling head. This is a well-known food product filling operation. Other types of food product filling apparatus include rotary piston fillers, inline fillers, etc. The present invention is not limited to the apparatus of FIG. 1 but could be utilized in conjunction with a variety of container filling apparatus in which food product or other products are dispensed downwardly into an open container.

Figure 2:
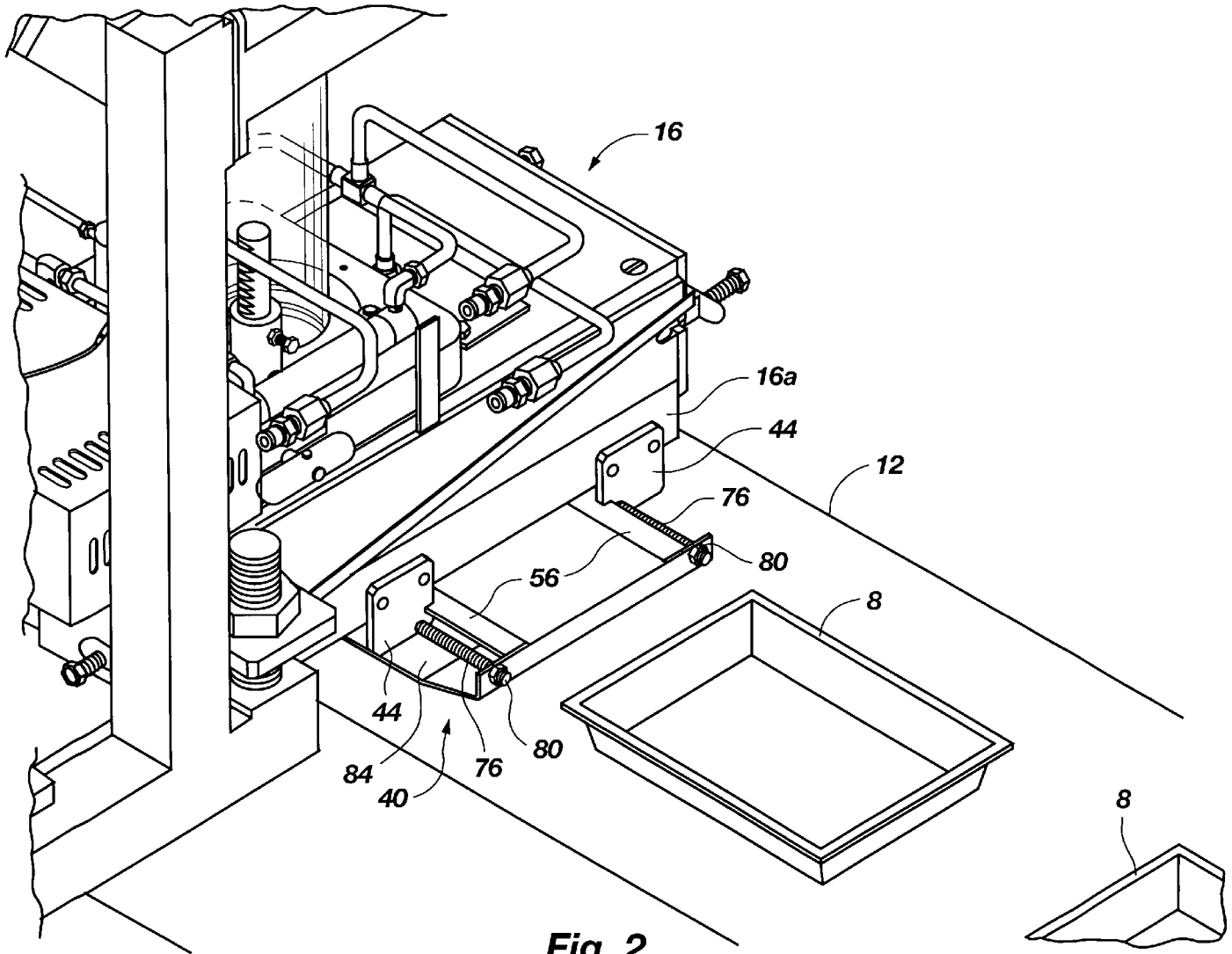
FIG. 2 is a perspective, fragmented, close-up view of the shielding structure of FIG. 1.
Figure 3:
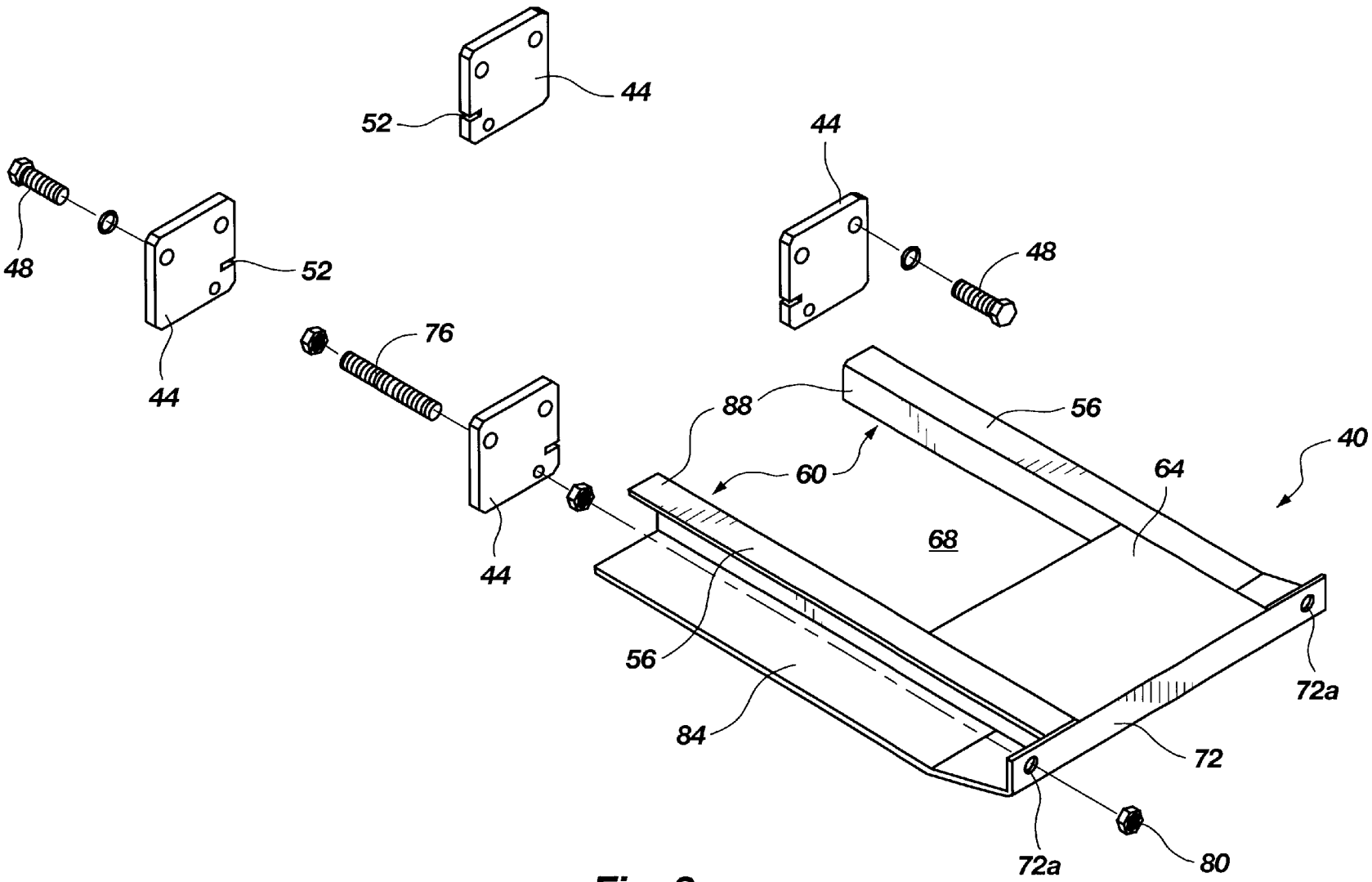
FIG. 3 is a perspective, exploded view of shielding structure made in accordance with the principles of the present invention.

FIG. 2 shows a perspective, close-up view of the filling head 16 of FIG. 1, with shielding structure 40 installed on the filling head. In particular, the filling head 16 includes a bar 16*a* which projects generally horizontally over the conveyor 12 and the shielding structure 40 is mounted on this bar by way of four brackets 44, best seen in FIG. 3. The brackets 44 are bolted to respective opposite sides of the bar 16*a* by bolts 48 (FIG. 3). The brackets 44 each include a notch 52 into which laterally extending lips 56 of rails or arms 60 of the shielding structure 40 slide so that the shielding structure may be held in place above the conveyor 12 and above the trays 8 moving successively under the filling head 16 (FIGS. 2 and 3).

The shielding structure 40, in addition to the rails 60 which project generally horizontally in a spaced-apart, parallel relationship, in the direction of movement of the conveyor 12, also includes a plate 64 which extends between the rails 60 at the rearward end, to leave a space 68, at least partially circumscribed by the rails 56 and plate 64. It is through this space that food product is dispensed from the filling head 16 into the trays 8. A rear plate 72 is disposed at the rearward end of the rails 60 and plate 64 and includes openings 72*a* through which bolts 76 are inserted (FIG. 2) which, together with nuts 80 allow for adjusting the position of the shielding structure 40 either forwardly or rearwardly, depending upon the needs of the user. That is, by adjusting the nuts 80, on the bolts 76, the position of the rear plate 72 against which the nuts 80 abut, and thus the position of the shielding structure 40, relative to the brackets 44, may be varied.

The rails or arms 60 each include the laterally extending upper lip 56 already mentioned, and a generally laterally extending cover or shielding plate 84 and a vertically disposed connecting web 88 extending between the upper lip and shielding plate.

Figure 4:
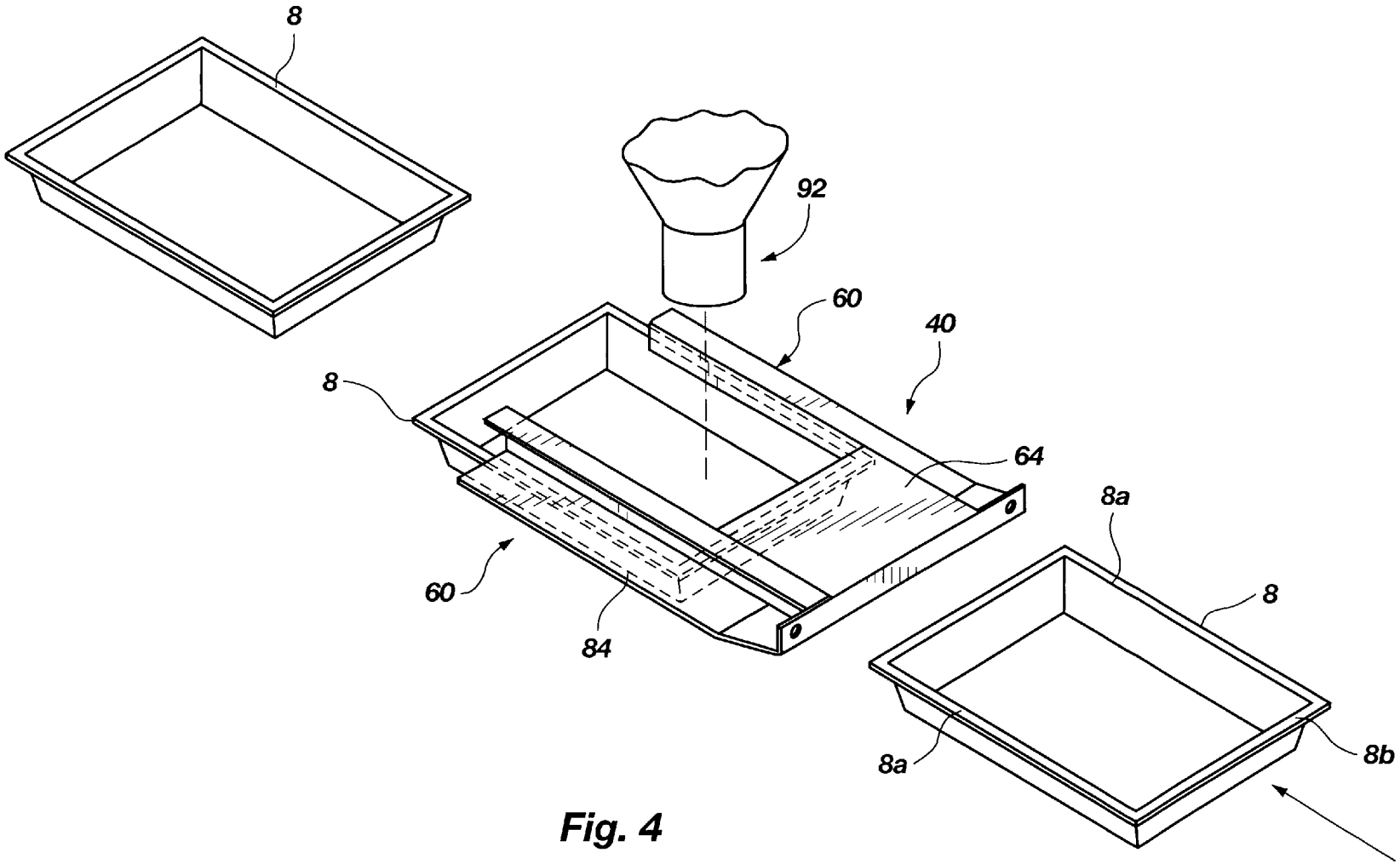
FIG. 4 is a perspective view illustrating the movement of containers (rectangular trays) under the shielding structure of the present invention.

FIG. 4 shows three trays 8 inline, as they would move on the conveyor (not shown) under the shielding structure 40. An exemplary food product dispensing nozzle 92 of the filling head 16 is shown positioned above the shielding structure 40 to dispense food product downwardly between the rails 60 into the trays 8. The nozzle 92 may be positioned lower or higher relative to the shielding structure 40 as determined by the needs of the user, but generally would be somewhat closer to the shielding structure than shown in FIG. 4.

The trays 8 are moved in position by the conveyor under the shielding structure 40 so that the shielding plates 84 overlie or cover at least a portion of opposing side rim flanges 8*a* of the trays 8 to prevent food product from splashing onto or otherwise contacting the upper surfaces of the flanges during filling. The plate 64 similarly overlies or covers the outwardly extending rim flange 8*b* at the rear of each tray during filling. Thus, those portions of rim flanges of the trays 8 covered by the shielding plates 84 and the plate 64 are shielded from food product. As a result, there is less likelihood that contaminants on the upper surfaces of the flanges of the trays would prevent positive sealing (by adhesive or otherwise) of covers to the flanges.

Note in FIG. 1 that the food product 96 is shown at the rear of the trays 8 so that only those flanges generally adjacent to the food product ultimately deposited would need to be shielded. Thus, the rails 60 only extend over a portion of the opposing side rim flanges 8*a* and not all the way to the forward end of the tray. However, shielding plates, covers or masks of a variety of shapes and designs could be provided to shield the rims of containers during filling so long as an opening similar to the space 68 (FIG. 3) were provided in the shielding structure to allow the passage therethrough of the food product.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. Structure configured for shielding generally horizontally planar rims of generally rectangular moving containers moved into position moving under a stationary flowable material dispensing nozzle of a container filling device comprising:

a base mountable on the container filling device below the level of the nozzle;

projections extending from the base generally horizontally, and configured to overlie at least a portion of the generally horizontally planar rim of the container when the container is positioned under the nozzle, while allowing material discharged from the nozzle to flow into the container, the projections comprising a pair of spaced apart, generally parallel rails which overlie opposing generally horizontally planar side rims of the generally rectangular container when the container is positioned under the nozzle; and a plate extending between the rails at one end thereof, configured to overlie a portion of the generally horizontally planar rim of the container which extends between the opposing side rims, when the container is in position under the nozzle.

2. Apparatus as in claim 1 wherein the spaced apart rails and the plate extending between the rails have a substantially "J" shaped cross section.

3. Apparatus as in claim 1, further comprising adjustment means for adjusting the position of mounting of the shielding structure on the container filling device forwardly or rearwardly relative to the moving containers.

4. Apparatus as in claim 1, wherein the shielding structure further comprises an inclined portion at one end thereof for receiving moving containers.

5. Apparatus configured for shielding the upper surface of generally horizontally planar rim flanges of a moving container positioned for filling with material from a stationary filling head of a container filling device, where the filling head is disposed above the container, the generally horizontally planar rim flanges generally defining at least two substantially parallel opposing side rim flanges, said apparatus comprising:

a mounting structure configured for attaching a shield to the container filling device below the filling head;

a shield carried by the mounting structure, said shield further comprising mask elements at least partly circumscribing an opening through which material is dispensed into the moving container, said mask elements disposed to shield at least a portion of the horizontally planar rim flanges from material dispensed from the filling head into the container, said mask elements further comprising:

a) arms configured to overlie at least a portion of the horizontally planar rim flanges, said arms projecting from the mounting structure in a generally parallel, spaced-apart relationship to cover respective opposing side rim flanges of the container, while allowing material to be dispensed from the stationary filling head, between the arms, to the container; and b) a plate extending between the arms at one end thereof to cover a generally horizontally planar rim flange of the container extending between said opposing horizontally planar side rim flanges.

6. Apparatus as in claim 5, wherein the arms configured to overlie at least a portion of the horizontally planar rim flanges and the plate extending between the arms define a generally rectangular opening.

7. Apparatus as in claim 5, wherein the arms configured to overlie at least a portion of the horizontally planar rim flanges and the plate extending between the arms have a substantially "J" shaped cross section.

8. Apparatus as in claim 5, wherein the mounting structure for mounting the shielding structure on the container filling device further comprises adjustment means for adjusting the position of the shielding structure forwardly or rearwardly relative to the moving container.

9. Apparatus as in claim 5, wherein the shielding structure further comprises an inclined portion at one end thereof for receiving moving containers.

* * * * *

UNITED STATES PATENT AND TRADEMARK OFFICE

CERTIFICATE OF CORRECTION

PATENT NO. : 6,041,835
DATED : March 28, 2000
INVENTOR(S) : Richard T. Price

It is certified that error appears in the above-identified patent and that said Letters Patent is hereby corrected as shown below:

Title page,
Item [73], the Assignee name should read -- Multi-Fill, Inc. --.

Signed and Sealed this

Twenty-first Day of January, 2003

JAMES E. ROGAN
*Director of the United States Patent and Trademark Office*